United States Patent [19]

Lee et al.

[11] 4,327,855

[45] May 4, 1982

[54] TOW DEFLECTOR DEVICE FOR PUDDLING JET

[75] Inventors: Benedict M. Lee; Gary W. Gibson, both of Kingsport, Tenn.

[73] Assignee: Eastman Kodak Company, Rochester, N.Y.

[21] Appl. No.: 162,703

[22] Filed: Jun. 25, 1980

[51] Int. Cl.[3] ..... B65H 51/16

[52] U.S. Cl. ..... 226/97; 28/289

[58] Field of Search ..... 226/97, 7; 242/47, 82, 242/83; 28/289; 19/160

[56] References Cited

U.S. PATENT DOCUMENTS

| | | | |
|---|---|---|---|
| 2,563,986 | 8/1951 | Bauer | 226/97 X |
| 3,281,913 | 11/1966 | Morehead et al. | 28/289 X |
| 3,387,756 | 6/1968 | Goodner | 226/97 |
| 3,580,445 | 5/1971 | Moore, Jr. | 226/97 |
| 3,656,383 | 4/1972 | Dibble et al. | 28/289 X |
| 3,706,407 | 12/1972 | King et al. | 226/97 |
| 3,866,849 | 2/1975 | Eschenbach | 242/47 |
| 4,153,212 | 5/1979 | Bauch et al. | 242/47 |
| 4,206,860 | 6/1980 | Lee | 226/97 |
| 4,215,805 | 8/1980 | Nielsen | 226/97 |
| 4,221,345 | 9/1980 | Schippers et al. | 242/47 |

*Primary Examiner*—Stanley N. Gilreath

*Attorney, Agent, or Firm*—Malcolm G. Dunn; Daniel B. Reece, III

[57] ABSTRACT

Device for connection to the outlet end of a gas jet tow puddler for puddling filamentary tow into a container, the device having a downwardly sloped gas-impervious plate positioned downstream from the gaseous jet outlet and against which filamentary tow impinges, becomes slowed and then cascades downwardly therealong; and a gas-impervious cylindrical shell opposed to and spaced from the exit end of the downwardly sloped plate and against which the filamentary tow travels from the downwardly sloped plate for subsequent slowing and movement therealong and then dropping from the cylindrical shell into the container below.

6 Claims, 4 Drawing Figures

TOW DEFLECTOR DEVICE FOR PUDDLING JET

TECHNICAL FIELD

Our invention is directed to a device for connection to the outlet end of a gas or air jet by and through which filamentary tow, as used in the textile industry, is drawn from a source of supply and is puddled into a container positioned beneath the gas or air jet, the device serving to impede the tow discharging speed.

DESCRIPTION OF PRIOR ART

In the textile industry, filamentary strands or filament tows obtained by whatever process may be involved are often placed or laid into containers such as boxes, cartons, cans, etc. which are used for holding and for temporary storage of the filamentary strands or filament tows and from which the strands or tows are later removed for subsequent processing. In the use of a placement or laying apparatus it is essential that the strands or tows be placed in the containers in a manner that will assure that the strands or tows can be readily removed without entanglement of the different strands. Attempt is therefore made to provide a mechanism that will place the strands or tows in the containers in regular plaits or folds superimposed on each other until the container becomes filled to the extent desired. Attempt is also made to fully utilize the space within the container. Some of these mechanisms are variously called "yarn puddlers" or "yarn piddlers".

Such yarn puddlers or yarn piddlers take many different forms. U.S. Pat. No. 3,281,913 discloses one form of puddling apparatus connected to an air jet and by which a rapidly moving yarn bundle may be packaged in a container in a cross-laid or criss-cross manner. The patented apparatus is used for packaging into containers any type of bundle such as yarns, rovings, tows and the like. The apparatus includes a series of longitudinally extending spring fingers spaced apart in circular array to form what is referred to in the patent as a "temporary storage chamber". The tow is forced under light pressure from the air jet into the temporary storage chamber while the air, which is entrained in the tow and providing kinetic energy for propulsion of the tow, is dissipated at an angle to the yarn flow through the tow in the storage chamber and through the spaced-apart fingers. The tow then falls substantially under its own weight to the tow bed within the container. The spring finger array is also called in the industry a "spring bustle".

In the use of the "spring bustle", the tow bed, which is formed within the container located directly beneath the air jet, is normally undisturbed because the air is dissipated laterally through the tow and through the spaced-apart fingers. When the yarn movement to the air jet breaks down for whatever reason, the air jet then is unobstructed by the yarn, which is normally temporarily stored within the spring bustle, and the air from the jet therefore directly hits the tow and disturbs its orderly arrangement. When the orderly arrangement is so disturbed, it is difficult to withdraw the yarn at a later time.

One result observed during use of the spring bustle is that there is always some interfilament entanglement occurring in the strand of the tow as it is temporarily stored within the spring bustle. If the interfilament entanglement is loosely formed, there usually is no problem in subsequent handling of the tow because the loose entanglement usually pulls free. Problems arise, however, when the interfilament entanglement becomes tightly formed, which can occur due to the type of tow being processed, or the particular adjustment of the spring fingers of the spring bustle, or the amount of air pressure being employed. The tight interfilament entanglement will often not pull free and will cause breaks during subsequent drafting processes or will form into a ball and break when attempt is made to pull the two through eyelet boards at a creel.

An object of the present invention is to minimize or eliminate entirely the occurrence of interfilament entanglement.

Another object of the present invention is to reduce or eliminate stick-slip, which occurs when the yarn is momentarily held up in the device and then suddenly becomes released due to the added pressure of yarn from upstream of the location of the stick-slip. The stick-slip action causes a loss of tension upon the yarn or tow and often, as a consequence, causes a roll wrap upstream of the puddler apparatus around the rolls used to pull the yarn ends from the spinning cabinets.

U.S. Pat. No. 3,580,445, for instance, discloses a guiding apparatus for eliminating filament entanglement and twist in a multifilament ribbon of yarn puddled by a gas-operated puddling jet. The apparatus is revolvably mounted on the end of a puddling jet and provides a snubbing action on the yarn whereby the adverse effect produced by the twisting vortex of the jet may be minimized.

In U.S. patent application Ser. No. 970,071, "Air Dissipator Apparatus for Air Jet Tow Puddling" filed Dec. 18, 1978 by Benedict M. Lee, now Pat. No. 4,206,860, an air dissipator apparatus for slowing the filamentary tow and dissipating some of the energy of the air entrained in the tow is disclosed. The apparatus has two main parts, each being formed from a series of spaced-apart, rigid fingers extending the length of the apparatus. The fingers for one part are generally flat while the fingers for the other part are generally round. The air entrained in the tow from the puddling jet becomes dissipated through the spaced-apart fingers as the tow is caused to impinge upon their surfaces and then to ricochet therefrom. Each main part extends a predetermined distance downstream from the jet outlet to which the apparatus is connected and on one side of the flow path for the air and the tow. One of the main parts has portions that cross over the jet flow axis of the jet outlet while the other main part remains on one side of the jet flow axis opposite the first-mentioned main part.

The first-mentioned main part of the air dissipator apparatus has a first portion extending downstream inwardly at an obtuse angle with respect to and across the jet flow axis and defining on its upstream surface a first surface below the jet outlet end and against which the filamentary tow initially impinges and ricochets therefrom. A second portion follows the first portion and is reversely bent to extend therefrom downstream outwardly at an obtuse angle with respect to and back across the jet flow axis. The second portion defines on its upstream surface a deflector surface that is downstream of and below the first surface and the jet outlet end and against which air and any fiber lubricant entrained in the air are deflected away from the flow path. A third portion follows the second portion and extends downstream essentially parallel to the jet flow axis.

The second-mentioned main part of the air dissipator apparatus has a first portion extending downstream and beyond the reversely bent second portion of the first-mentioned main part, the first portion being generally parallel to the jet flow axis. A second portion follows the first portion and extends downstream inwardly at an obtuse angle with respect to and toward the jet axis. A third portion follows the second portion and extends therefrom downstream in a direction generally parallel to the jet flow axis. The first and second portions define surfaces against which the filamentary tow next impinges and ricochets therefrom in its movement along the flow path toward the container.

The deflector surface on the second portion of the first-mentioned main part of the air dissipator apparatus may be a plate member against which air is deflected away from the flow path.

The second-mentioned main part of the air dissipator apparatus may be adapted to pivot away from the first-mentioned main part and from the jet flow axis, and may have some suitable means for urging the second main part in return to its initial nonpivoted position.

Alternately the first surface on the first-mentioned main part of the air dissipator apparatus may be defined along its length by spaced side-by-side members between which some of the air entrained in the filamentary tow diffuses, while the other portions of the first-mentioned main part and all of the portions of the second-mentioned main part may be solid surfaced structures.

In the use of the above-described air dissipator apparatus, special care must be taken as to construction, assembly and finishing of the rigid fingers to assure that there are no rough parts upon which filaments can catch and pull away from the body of the tow strand and hence interfere with the integrity of the tow strand per se. At times also, depending upon the character of the tow being handled and the amount of air pressure employed, some parts of the tow would be blown between the spaced-apart rigid fingers and trapped therein during operation.

Still another object of the present invention, therefore, is to simplify the construction and considerably reduce the number of parts required, such as are disclosed in the preceding described air dissipator apparatus, and thereby reduce the potential possibility of yarn snags on the various surfaces that are involved.

It has been discovered that it does not appear to be necessary in many instances to designedly "dissipate" from the tow the air, which is entrained in the tow from the air jet, but rather allow the air to gradually become diffused as the tow moves from the puddler jet. In this latter mode of operation, the air does not appear to directly hit and disturb the tow bed in the container below the puddling apparatus. It is only necessary to retard or slow the speed of the tow to the extent that the tow drops down upon the tow bed, but without forceful penetration thereof and hence undesirably becoming entangled with the tow layers pereviously deposited within the container. The entrained air also appears to provide an air-bearing effect for the tow in its contact with surfaces downstream of the puddler jet and thus allows for gradual diffusion of the air.

A still further object of the present invention, therefore, is to provide a device adapted to be readily connected to the downstream outlet end of a puddler jet so as to retard or slow the speed of the tow to an operable level that will enable the tow to be lightly deposited upon the tow bed, with gradual diffusion of the air occurring as the tow moves through the device.

Other objects of the invention will become apparent from the description hereinafter disclosed.

DISCLOSURE OF INVENTION

In accordance with the present invention, we provide a device that is adapted to be readily connected to the outlet end of a gaseous jet from and by which a bundle of filamentary tow is gas puddled into a container positioned below the device, the gas from the jet being entrained in the bundle. A deflector plate within the device is positioned a predetermined distance downstream from the outlet end of the gaseous jet and extends at a predetermined angle with respect to and across the axis of gaseous flow from the jet outlet end. The deflector plate defines on its upstream surface a first downwardly sloped gas impervious surface below the jet outlet end and against which the filamentary tow impinges, becoming retarded or slowed by such impingement, and then cascades downwardly therealong. The deflector plate may be essentially flat, and has side members extending upwardly and tapering outwardly therefrom to either side of the tow movement to limit the extent of expansion of the filamentary tow as it impinges and splays upon the downwardly sloped surface. The flat deflector plate and each side member define therebetween an angle greater than 90° so that the tow will not become frictionally confined due to the splaying or expansion of the tow as it impinges.

The deflector plate may alternately be provided with a dished surface extending transversely with respect to the movement of the filamentary tow and by which the flow of the tow is centered as it moves along the deflector plate. The dished deflector plate may also be provided with upwardly extending outwardly tapering side members for the purpose of limiting the extent of expansion of the tow after it impinges and splays upon the downwardly sloped surface, with each side member and the dished deflector plate defining therebetween an angle greater than 90°.

The device is further provided with a second member that has an arcuate configuration for partially confining and directing the flow of gas and further limiting the expansion of the filamentary tow, with the center of the arc being parallel to the axis of gaseous flow. This second member is positioned adjacent to and spaced from the exit end of the deflector plate and defines an opposed gas impervious curved surface against which the filamentary tow is carried by its momentum from the first downwardly sloped surface for subsequent movement of the tow therealong. The movement of the tow is further retarded or slowed by impingement with this "opposed surface". The tow then drops away from the second member into a container positioned beneath the device. The second member with its opposed surface and the downwardly sloped surface of the deflector plate from therebetween an acute angle or angle less than 90°.

A connecting collar is provided at the upstream end of the device for connecting the device to the outlet end of a gaseous jet. The gaseous jet in turn may be pivotally adjusted so as to change the angle of movement of the filamentary tow with respect to the opposed surface on the second member of the device following initial contact of the tow with such opposed surface. The purpose of this adjustment is to assure that the filamentary tow will drop vertically straight downwardly from the opposed surface on the second member and into the container. The aforementioned second member may define a cylindrical shell for partially confining the flow of gas and the movement of the filamentary tow, with the cylindrical shell having its center parallel to the axis of the gaseous flow.

Although the cylindrical shell of the device has been described as having its center being parallel to the axis of the gaseous shell, it should be understood that this is only done to make the device more compact since the remaining portion of the shell to the sides of and to the rear of the deflector plate are not contacted by the tow. If the cylindrical shell were made larger, the center of the shell and the axis of the gaseous flow could coincide.

The deflector plate may be suitably connected to the upper end of the cylindrical shell, the upper end being that intended to be so located during operation of the device when it is connected to the outlet end of a gas jet apparatus or puddling apparatus.

BRIEF DESCRIPTION OF DRAWINGS

The details of our invention will be described in connection with the accompanying drawings, in which.

BEST MODE FOR CARRYING OUT INVENTION

Figure 1:
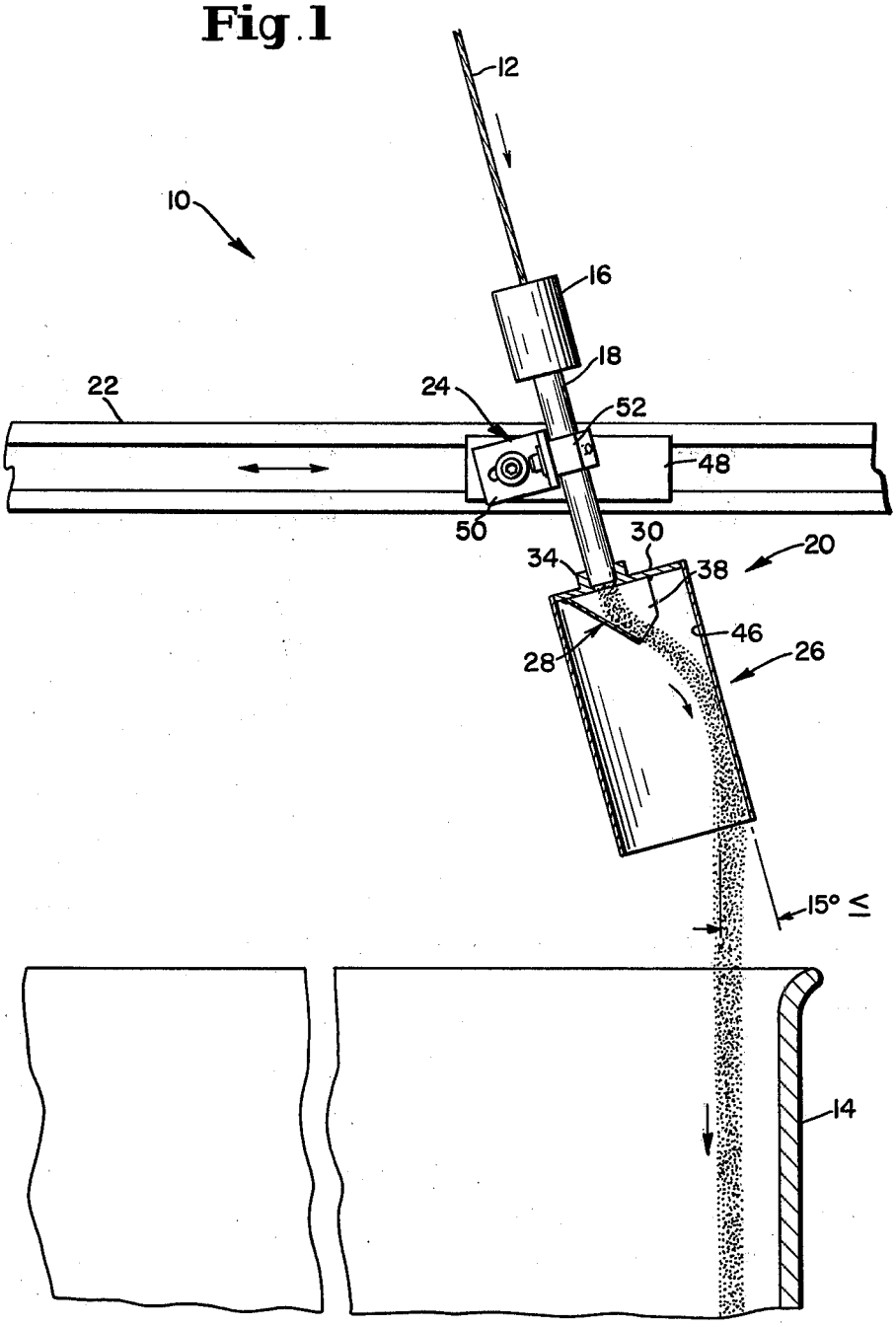
FIG. 1 is an elevational view showing the device as connected to a puddling jet positioned over or above a container.
Figure 2:
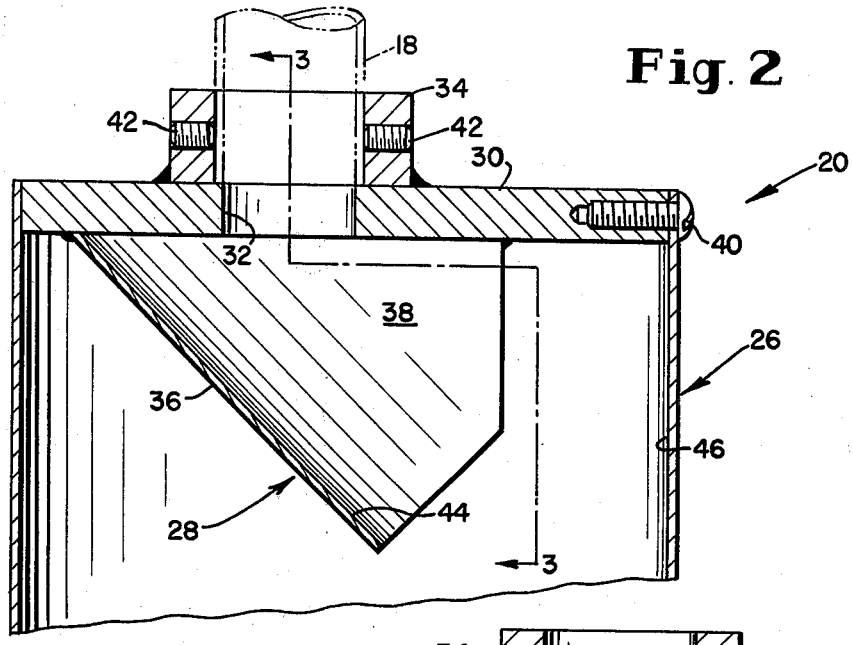
FIG. 2 is an enlarged elevational view of the device, partly broken away.
Figure 3:
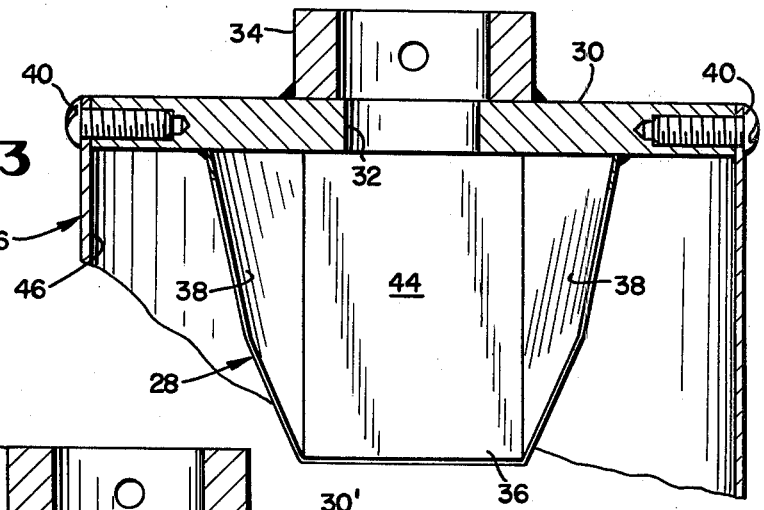
FIG. 3 is an enlarged elevational view of the device taken along line 3—3 of FIG. 2 illustrating the deflector plate assembly.

With reference to the drawings, 10 designates the puddling apparatus by which the filamentary tow 12 may be puddled into container 14 positioned beneath the puddling apparatus. The puddling apparatus includes a puddling jet 16, a jet tailpipe 18 connected to the puddling jet and a tow deflector device 20 suitably connected to the outlet end of the jet tailpipe of the puddling jet.

The puddling apparatus 10 is connected for reciprocal movement in a horizontal plane to a guiderail structure which is shown in part at 22. The connection may be made by the use of a pivotally adjustable universal coupling 24 suitably mounted for movement on the guiderail structure and to which the jet tailpipe 18 in turn may be also connected for adjustable movement along the axis of the jet tailpipe to adjust the height of the deflector device relative to the container 14. The purpose for the pivotally adjustable universal coupling will be described later.

The mechanism for driving the puddling apparatus in reciprocal movement is well known in the art and is therefore not illustrated herein. Reference, however, may be made to U.S. Pat. No. 3,656,383, for example, wherein one form of a driving mechanism is illustrated.

TOW DEFLECTOR DEVICE

The tow deflector device 20 may comprise a deflector tailpipe 26 and a deflector plate assembly 28.

The deflector plate assembly 28 includes a closure member 30; a circular opening 32 extending through the closure member; a shaft collar 34 coaxially aligned with the circular opening 32 and suitably secured to the upper surface of the closure member 30; a deflector plate 36 secured at one end to the lower surface of the closure member 30; and side members 38 secured to the closure member 30 and which may be integrally connected to either side of the deflector plate 36.

The deflector plate assembly 28 may be readily secured within the upper end of the deflector tailpipe 26 as by providing a series of spaced threaded holes around the peripheries of the closure member and of the upper end portion of the deflector tailpipe and threading therethrough and in with matching screws 40. In this manner the deflector plate assembly may be readily removed from the deflector tailpipe for convenient visual inspection within the deflector tailpipe or of the deflector plate assembly, if desired.

The shaft collar 34 of the deflector plate assembly is provided with an inside diameter that is larger than the diameter of the circular opening 32 so that upon connecting the tow deflector device 20 to the outlet end of the jet tailpipe 18, the jet tailpipe outlet end may seat upon that portion of the upper surface of the closure member that remains between the edge of the circular opening and the inner edge of the shaft collar. The shaft collar may also be provided with a series of spaced threaded holes around its periphery so that the tow deflector device may be frictionally secured to the jet tailpipe outlet end as by screws 42 engaging against the sides of the jet tailpipe.

When the tow deflector device 20 is connected to the jet tailpipe 18, the deflector plate 36 is then positioned at a predetermined distance downstream from the jet tailpipe outlet end and also extends at a predetermined angle with respect to and across the axis of the path of gaseous flow from the jet tailpipe. The deflector plate thus defines on its upstream surface 44 a downwardly sloped gas impervious surface, which is below the jet tailpipe outlet end and against which the filamentary tow 12 will initially impinge. The angle of the deflector plate with respect to the closure member 30 may vary in the range of about 30° to about 70°, and preferably in the range of about 45° to about 55°.

The side members 38 each define between the respective side member and the deflector plate 36 an angle greater than 90° and between the closure member and a side member an angle less than 90° with the result that the sidewalls taper outwardly from the deflector plate. The reason for this construction is to minimize the possibility of the filamentary tow becoming frictionally obstructed between the deflector plate and the side members. The impingement of the tow upon the downwardly sloped surface is such that the tow tends to splay and expand outwardly slightly. The side members thus serve to limit or restrict such expansion while affording sufficient relief against the tow becoming obstructed.

The deflector tailpipe 26 may be formed from a cylindrical pipe or shell of suitable diameter to accommodate the number of the filaments making up the filamentary tow to be puddled. The arcuate configuration of the interior surface of the cylindrical shell is thus so positioned adjacent to and spaced from the exit end of the downwardly sloped surface of the deflector plate 36 so as to provide an opposed gas impervious curved surface 46 against which the filamentary tow will be carried by its momentum from the first downwardly sloped surface. The arcuate character of the opposed surface 46 serves for also limiting or restricting the expansion of the filamentary tow as it impinges against such opposed surface as it cascades from the deflector plate. The downwardly sloped surface of the deflector plate lies on a plane that intersects the opposed surface of the deflector tailpipe at an acute angle or angle less than 90°.

The extent to which the filamentary tow 12 moves along the opposed surface 46 of the deflector tailpipe is determined by the angle at which the jet tailpipe 18 is clamped to the universal coupling 24. The angle at which the jet tailpipe is adjusted is determined in turn by whatever it takes to achieve a vertical drop of the filamentary tow into the container 14. Depending upon such factors as the air pressure and the size of tow being handled, the tow may rebound from the opposed surface 46 to as much as 15°, as shown in FIG. 1. It is therefore necessary to adjust the position of the tow deflector device 20 so as to assure that the tow will drop vertically into the container as closely as possible to the side wall of the container. To this end, the universal coupling 24 is provided with a mounting plate 48 suitably connected for movement along the guiderail structure 22 and a pivot bracket 50, with the pivot bracket having connected thereto a jet mount 52 within which the jet tailpipe may be received and clamped as by a setscrew (not shown).

Figure 4:
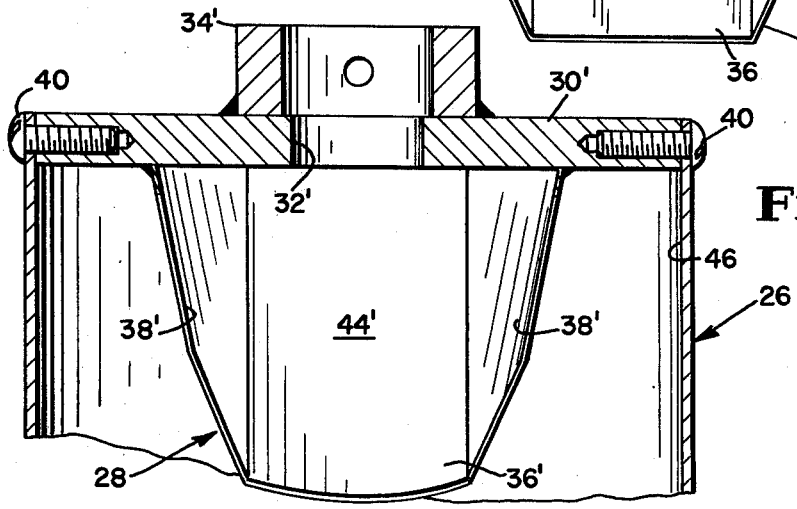
FIG. 4 is a view similar to FIG. 3, but represents an alternate embodiment of the deflector plate assembly.

In an alternate embodiment, FIG. 4, the deflector plate 36' may have a dished surface which extends transversely with respect to the movement of the filamentary tow. The dished surface may be used to center the flow of the filamentary tow with respect to the deflector plate as the tow cascades therefrom. The reference numbers having prime marks thereafter serve to identify similar elements previously described.

OPERATION

In operation, the filamentary tow 12 is carried by the velocity of the air through the jet tailpipe 18 into the tow deflector device 20, where the tow impinges upon the gas impervious downwardly sloped surface of the deflector plate 36 and then cascades therefrom for subsequent impingement against and along the gas impervious opposed surface 46 and then dropping therefrom vertically into the container 14 which is positioned below the tow deflector device 20 for final disposition upon a tow bed (not shown) being formed within the container.

The range of air pressures employed in the puddling jet 16, for instance, may extend from about 30 to about 50 psi., and preferably about 40 to about 50 psi. may be used. The pressures employed depend, of course, upon the size of the puddler jet being used. It has been found, however, that air consumption is actually less than that used in the previously described "spring bustle".

The tow size of the filamentary tow handled by the tow deflector device may range from about 30,000 to about 150,000 total denier, depending, of course, upon the size of the apparatus used.

Some advantages noted in use of the invention described herein include lower air pressure required and less air consumption as compared to the "spring bustle" described earlier. Also "balling" of the tow has been eliminated which would occasionally take place in the "spring bustle" apparatus described above. Further, the number of breaks occurring during the processing of the tow and related to the puddling apparatus have either been reduced or completely eliminated. Consistent puddling tow tension has been maintained, thus reducing or eliminating all wraps that would occur on the tow puddling rolls (not shown) located prior to the puddler jet apparatus. Still further entanglement of the tow in the tow bed has been significantly reduced or eliminated, enabling the tow to be more readily withdrawn from the container into which the tow is temporarily stored. Also, yarn snagging has been eliminated as compared to the operation of the "air dissipator apparatus" as well as the "spring bustle". The structure is also more simple to fabricate, as compared to the other two devices.

The noise from the use of the puddler jet may be suitably muffled by placement of an encircling muffler around the disclosed cylindrical shell of the device disclosed.

The invention has been described in detail with particular reference to preferred embodiments thereof, but it will be understood that variations and modifications can be effected within the spirit and scope of the invention.

We claim:

1. Device adapted to be connected to the outlet end of a gaseous jet from and by which a bundle of filamentary tow is gas puddled into a container positioned below the device, the gas from the jet being entrained in said bundle, said device comprising;

a plate means positioned a predetermined distance downstream from the outlet end of said gaseous jet and extending at a predetermined angle with respect to and across the axis of gaseous flow from said jet outlet and defining on its upstream surface a first downwardly sloped gas impervious surface below said jet outlet end and against which said filamentary tow impinges, becomes slowed and then cascades downwardly therealong;

said plate means having extending upwardly and tapering outwardly therefrom to either side of the filamentary tow movement side members adapted to limit the extent of expansion of said filamentary tow as it impinges and splays upon said downwardly sloped gas impervious surface, said plate means and each said side member defining therebetween an angle greater than 90°; and a cylindrical shell encircling said plate means and partially confining and directing the flow of gas and being positioned adjacent to and spaced from the exit end of said plate means to define an opposed gas impervious curved surface against which said filamentary tow is carried by its momentum from said downwardly sloped surface for subsequent slowing and movement therealong and for being further limited in its expansion as it impinges and splays against said opposed gas impervious surface, and then dropping away therefrom into said container below; said downwardly sloped surface and said opposed gas impervious curved surface forming therebetween an acute angle.

2. A device as defined in claim 1, wherein said plate means is an essentially flat plate.

3. A device as defined in claim 1, wherein said plate means is a plate having a dished surface extending transversely with respect to the movement of said filamentary tow by which the flow is centered.

4. A device as defined in claim 1 and including in combination said gaseous jet, and wherein means is provided on said device for connecting said device to said outlet end of said gaseous jet, and means is provided on said gaseous jet for pivotally adjusting said gaseous jet to which said device is connected so as to change the angle of movement of the filamentary tow with respect to said opposed surface on said device following initial contact of said filamentary tow with said opposed surface.

5. A device as defined in claim 1, wherein said cylindrical shell is open at its exit end for said flow of filamentary tow and is fitted with a closure at its upper end, said closure at the upper end defining therein a central opening surrounded by a cylindrical collar by which said device is connected to said gaseous jet.

6. A device as defined in claim 5, wherein said plate means is connected at its one end to said closure at the upper end of the device, said closure and said downwardly sloped surface defining therebetween an acute angle.

* * * * *